United States Patent [19]

Stuart et al.

[11] 4,058,184

[45] Nov. 15, 1977

[54] SCAFFOLD

[75] Inventors: Alistair J. Stuart; James B. Burch, both of Indianapolis, Ind.

[73] Assignee: Hugh J. Baker & Company, Indianapolis, Ind.

[21] Appl. No.: 677,481

[22] Filed: Apr. 15, 1976

[51] Int. Cl.[2] ..... E04G 3/10

[52] U.S. Cl. ..... 182/128; 182/2; 182/142

[58] Field of Search ..... 182/128, 142, 2, 150, 182/229

[56] References Cited

U.S. PATENT DOCUMENTS

| | | | |
|---|---|---|---|
| 1,090,856 | 3/1914 | Johnson | 182/128 |
| 3,306,396 | 2/1967 | Goss | 182/2 |
| 3,504,461 | 4/1970 | Copeland | 182/2 |
| 3,955,685 | 5/1976 | Smith | 182/142 |

FOREIGN PATENT DOCUMENTS

| | | | |
|---|---|---|---|
| 554,438 | 3/1958 | Canada | 182/128 |

*Primary Examiner*—Reinaldo P. Machado
*Attorney, Agent, or Firm*—Jenkins, Coffey & Hyland

[57] ABSTRACT

A movable scaffold for use in gaining access to the inside wall of an upright cylindrical tank such as a petroleum refinery reactor tower. The scaffold comprises a central frame having four radially extending, adjustable arm sets each connected to a scaffold platform, or cage, and hydraulically actuated to bring the platforms into working proximity with the inside tank wall. The scaffold platforms are each connected by cables received over sheaves at the top of the tank to winches outside the tank. Said winches are controllable to rotate the platforms within the tank, and/or to adjust the elevation of the platforms within the tank.

36 Claims, 14 Drawing Figures

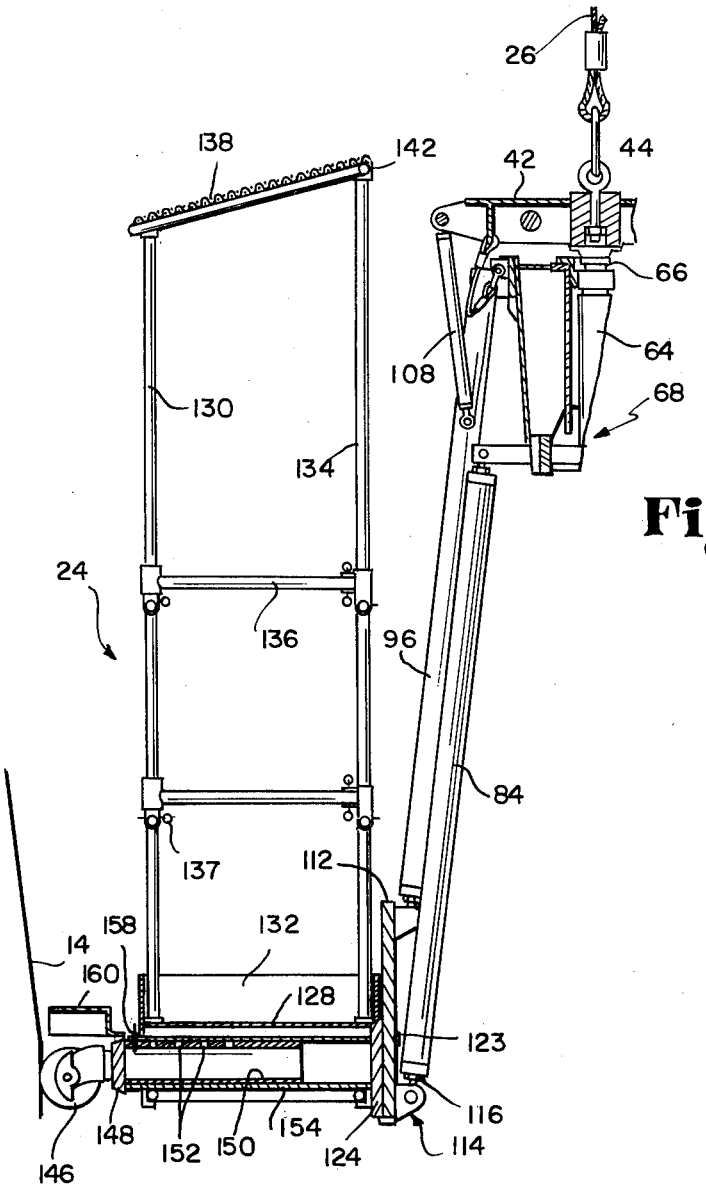
Fig. 7
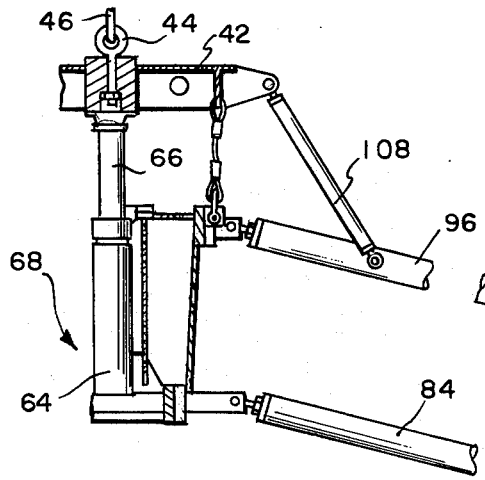
Fig. 6
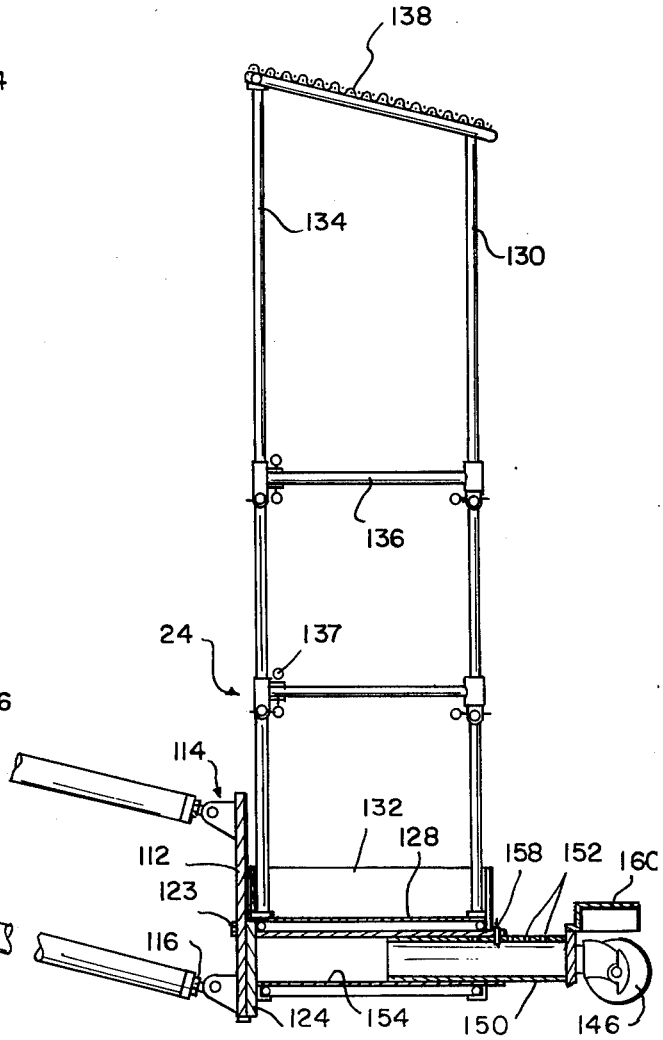

SCAFFOLD

BACKGROUND OF THE INVENTION

This invention relates to scaffolds. More specifically, this invention relates to a hoistable, rotatable scaffold for use in gaining access to the inside wall of an upright, variable diameter cylindrical tank.

Upright cylindrical tanks are widely used throughout industry and are particularly valuable in oil refining processes where they are used as catalytic reactor towers. Typically, such reactor towers have a height of up to about two hundred feet, and a diameter varying between about 20 feet and 40 feet over the tank height. Such tanks are formed from steel or the like, and are used in distilling various liquids at various elevations thereof. Such distilled liquids run down the inside wall of the tank for collection, and this causes a slag formation on the inside tank wall over a period of time. This slag build-up is usually more severe toward the top of the tank, and is highly detrimental to the refining process. Accordingly, the reactor tank must be shut down, or removed from production, once or twice each year to allow the slag deposits on the inside wall of the tank to be removed.

According to conventional practice, a small manhole having a diameter of about thirty inches is provided near the bottom of a refinery reactor tank to allow access inside. When the tank is shut down for maintenance, the manhole is opened and scaffolding material is passed therethrough. Inside the tank, a conventional tubing and plank scaffold is constructed from the floor all the way to the top, and in close proximity with the inside tank wall. Construction of the scaffold, however, is a difficult and time-consuming task because of the tight working conditions inside the tank as well as the varying tank diameter. Thus, scaffold construction can take up to several working days to complete. This is highly undesirable in the refining industry wherein an idle reactor tank can result in losses of substantial revenue each day.

Once the scaffold is constructed within the tank, it is common practice for workers to clean the inside wall of the tank beginning at the top and moving downwardly toward the bottom. In this manner, all of the inside tank wall is reached, with the scaffold being gradually dismantled as the work progresses. However, such dismantling is also a time-consuming task to thereby further prolong the time the reactor tank is idle. Further, slag chunks weighing as much as 100 pounds can become dislodged from the tank wall during cleaning, and such chunks can fall against and damage the scaffold below the workers to endanger the scaffold stability.

The scaffold of this invention overcomes all of the disadvantages and problems of conventional tubing and plank scaffolds used in the prior art by providing a scaffold which is quickly and easily assembled and disassembled within a reactor tank. Further, the scaffold of this invention is supported from above and is vertically movable to any elevation within the tank. Moreover, the scaffold of this invention is diametrically adjustable and rotatable within the tank to allow workers easy access to any portion of the tank inside wall.

SUMMARY OF THE INVENTION

In accordance with the invention, a scaffold for use in gaining access to the inside wall of an upright cylindrical tank is provided having a central frame with four radially spaced, outwardly extending sets of support arms. The arm sets are each connected to a scaffold platform, or cage, and are movable between radially extended and retracted positions by means of a reversible hydraulic cylinder on said central frame to thereby move the cages into working proximity with the tank wall.

Each of the four scaffold platforms is connected at opposed sides thereof to a pair of cables for supporting the scaffold within the upright tank. The four pairs of cables are received over sheave assemblies arranged radially about the top of the tank generally between the platforms, with each sheave assembly receiving a pair of cables connected to adjacent sides of adjacent platforms. From the sheave assemblies, the cables are wound about individual winches which, when simultaneously operated in the same direction to wind or unwind cable, serve to correspondingly raise or lower the scaffold within the tank. Or, when the winches are operated to oppositely wind and unwind each pair of cables connected to opposed sides of a scaffold cage, the winches serve to rotate the scaffold within the tank.

BRIEF DESCRIPTION OF THE DRAWINGS

The accompanying drawings illustrate the invention. In such drawings:

FIG. 6 is a fragmented side elevation of a portion of the scaffold showing a scaffold cage in an extended position;

FIG. 7 is a fragmented side elevation of a portion of scaffold showing a scaffold cage in a retracted position;

DETAILED DESCRIPTION OF THE PREFERRED EMBODIMENT

Figure 1:
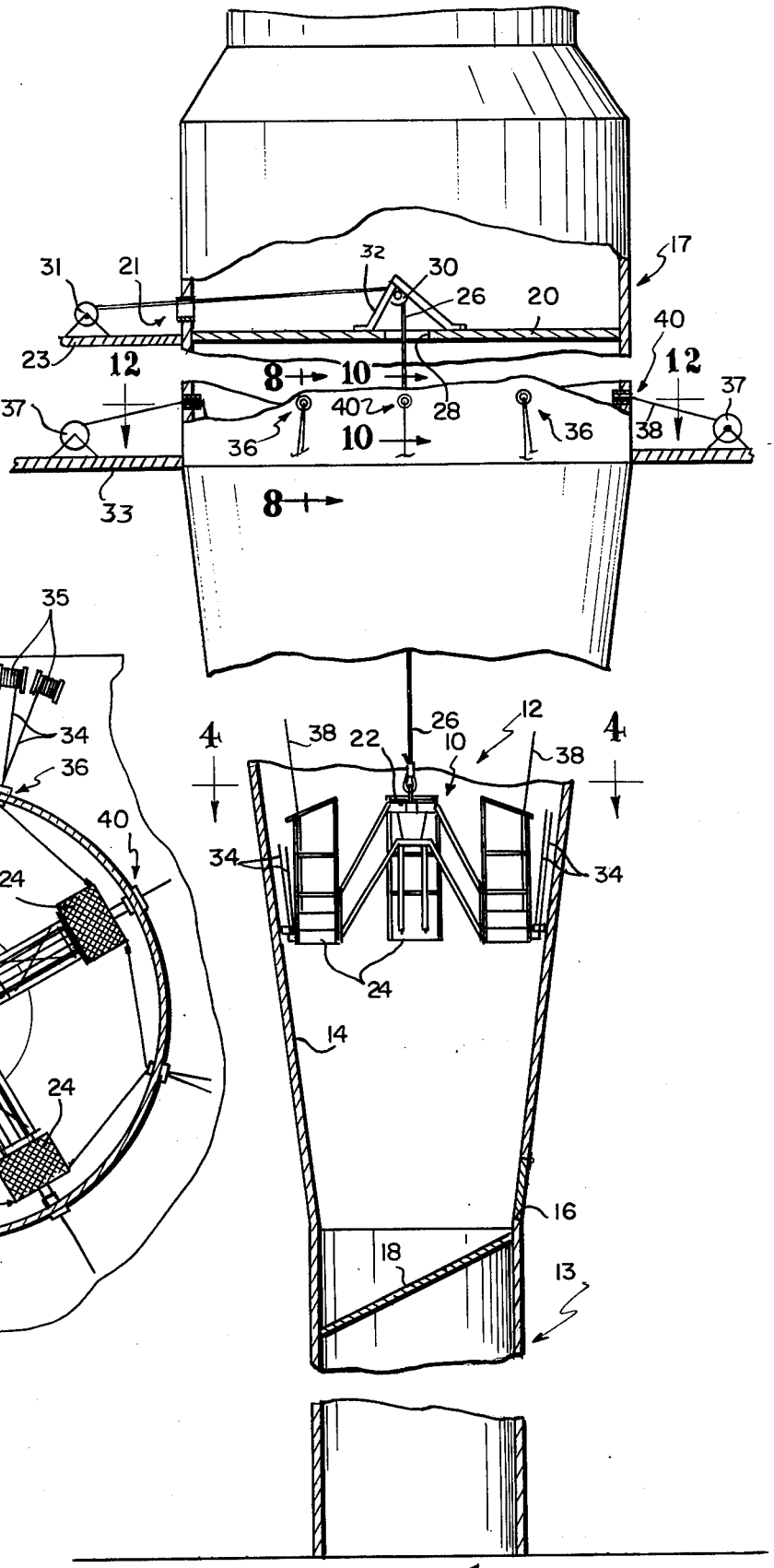
FIG. 1 is a fragmented vertical section of a refinery reactor tower having a scaffold of this invention installed therein.

A scaffold 10 of this invention is shown generally in FIG. 1 installed within a refinery reactor tank 12. The tank 12 comprises an upright cylinder formed from steel or the like, and may have an overall height of from about 150 to 200 feet. The tank has a lower section 13 with a constant diameter of say about 20 feet. The lower section 13 blends into a central section 15 having a diameter which gradually increases over approximately half the tank height to say about 40 feet. The central section 15 in turn blends into an upper section 17 of constant diameter at the top of the tank.

In typical refinery processes, the tank is used to distill various petroleum products at various elevations thereof. The distilled products run down the inside wall 14 of the tank for collection, and this results in a gradual slag build-up on the inside tank wall. This slag build-up must be periodically removed for proper tank operation, and accordingly, the tank 12 is periodically shut down to allow the wall 14 to be cleaned together with the performance of other regular maintenance. During such a shutdown period, a manhole 16 near the bottom of the central tank section 15 is opened to allow access to the tank interior. The manhole 16 is typically about thirty inches in diameter, and is disposed above a permanently constructed sloping tank floor 18. Further, during shutdown periods, a temporary walkway 20 is constructed near the top of the tank to allow access to valves and other refining equipment (not shown) located in that vicinity.

The scaffold 10 of this invention generally comprises a central supporting frame 22 connected to four radially spaced scaffold platforms, or cages 24. The frame 22 and cages 24 are fed through the small manhole 16 in relatively small sections for assembly inside the tank. Conveniently, if desired, a short tubing and plant scaffold (not shown) can be built upon the sloping tank floor 18 to provide a level surface for assembly. The entire scaffold 10, when assembled, is partially supported by a central cable 26 of wire rope or the like connected to the central frame 22 and extending upwardly to the upper walkway 20. The cable 26 is received upwardly through a walkway opening 28 and over a sheave 30 supported by a tripod assembly 32 fixed to the walkway. From the sheave 30, the cable extends over a single sheave assembly 21 mounted in the tank wall, and further to an appropriate winch 31. Conveniently, this winch 31 is mounted near and slightly below the single sheave assembly 21 on a tower platform 23 which is permanently constructed about the tower to provide worker access to the tower during refining operation. Alternately, the winch 31 can be positioned in any convenient location, such as on the ground.

The scaffold 10 is primarily supported by a series of cage cables 34 connected to each side of each scaffold cage 24. Thus, eight cage cables 34 are provided for the four cages, and extend upwardly as shown in FIG. 1 for reception in pairs over four radially spaced double sheave assemblies 36 mounted in the tank wall near the top thereof immediately below the temporary walkway 20. The cage cables 34 pass outwardly through the tank and are wound about individual winches 35 mounted near and slightly below the sheave assemblies 36 on a second tower platform 33, as will be hereafter described in more detail. In a similar manner, safety cables 38 are supplied to each of the cages 24 for attachment to workers therein, and extend upwardly from their cages for reception over single sheave assemblies 40 identical to the upper single sheave assembly 21 and positioned radially about the top of the tank. Said safety cables 38 pass outwardly through the tank and are wound about individual winches 37 which are also conveniently mounted on the tower platform 33. Alternately, the winches 35 and 37 can be mounted in almost any convenient location.

Figure 2:
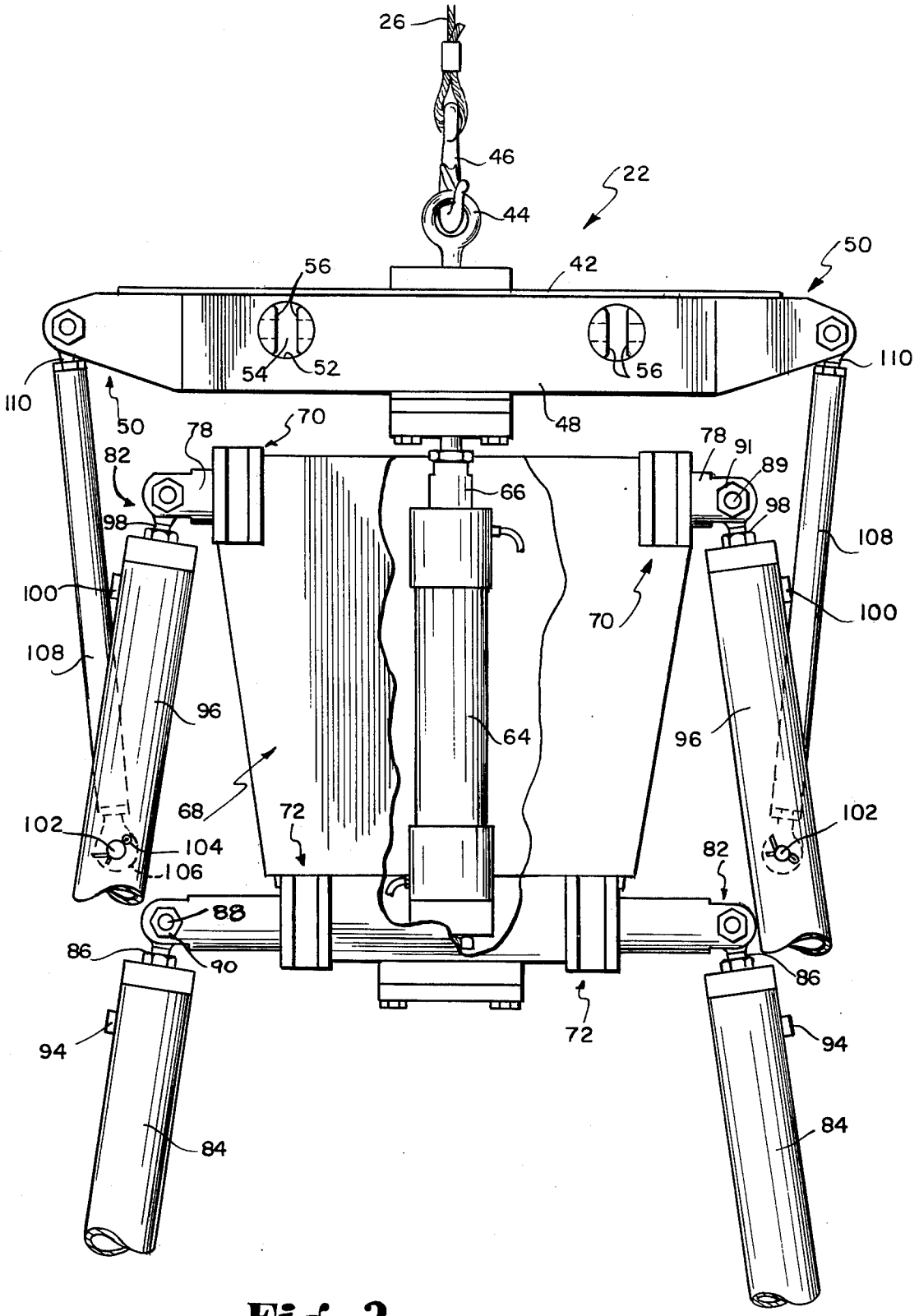
FIG. 2 is an enlarged fragmented elevation view of the scaffold supporting frame, with portions thereof broken away.
Figure 3:
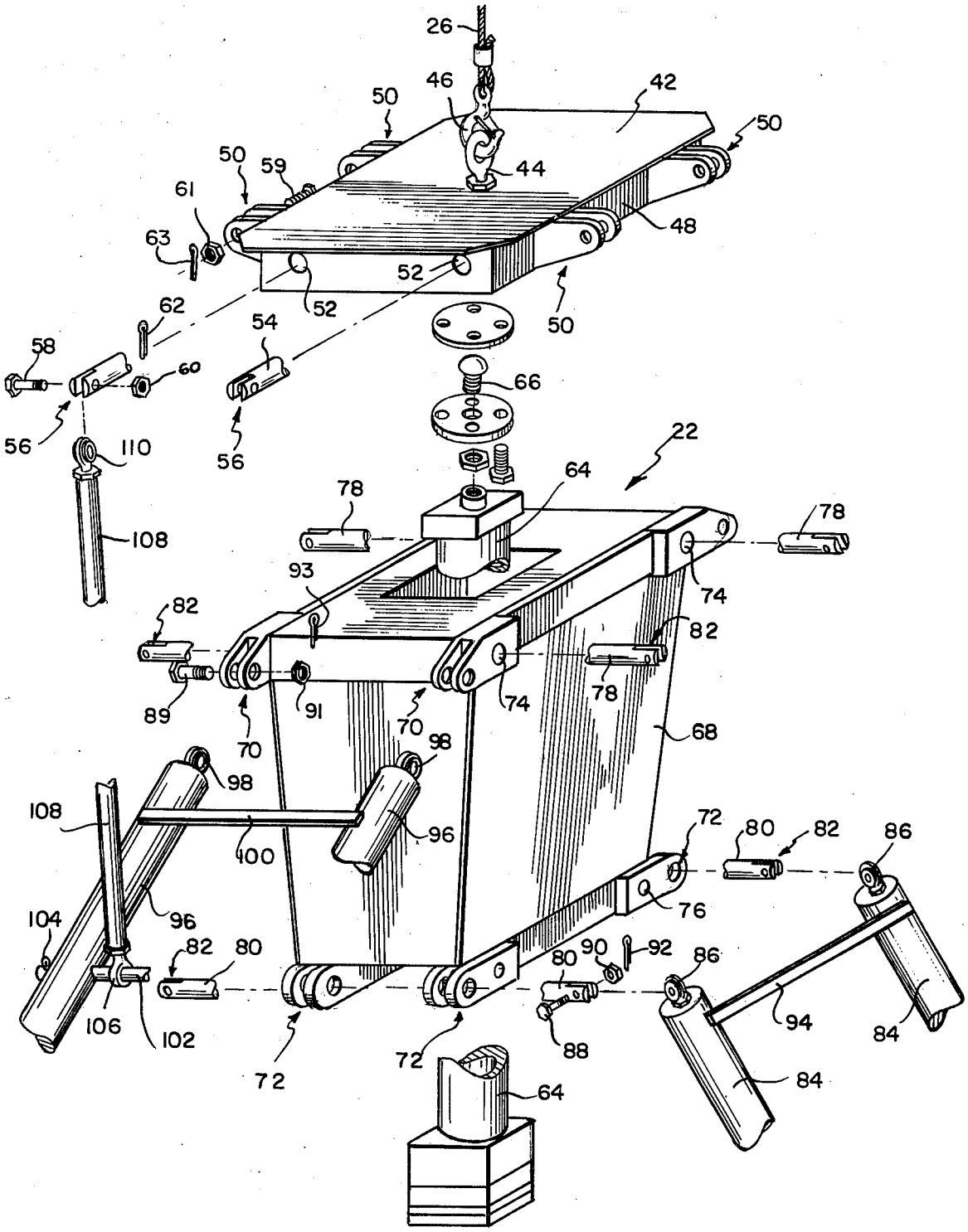
FIG. 3 is an enlarged exploded perspective view of the scaffold supporting frame, with portions thereof broken away.

The scaffold central supporting frame 22 is shown in detail in FIGS. 2 and 3, and comprises an upper rectangular plate 42 having an upwardly projected eyebolt 44 connected thereto for connection to the central cable 26 by a hook 46. Importantly, as with all portions of the scaffold, the upper plate 42 is sized and shaped for ready passage through the tank manhole 16. The upper plate 42 has a downwardly projecting rectangular skirt 48 having spaced yokes 50 projecting outwardly from two opposed sides thereof. The remaining opposed sides of the skirt 48 have aligned pairs of holes 52 for reception of cross bars 54 having connector yokes 56 at each end thereof. Said cross bars 54 are retained in position with respect to the plate 42 by a bolt 58 received through each connector yoke 56 and having a nut 60 threaded thereon. If desired, a safety cotter pin 62 is received through the threaded end of each bolt 56 to positively lock the cross bars 54 in position. Thus, the upper plate 42 has a pair of spaced yokes 50 or 56 projecting outwardly on all sides thereof.

A reversible hydraulic cylinder 64 is part of the central frame 22, and has its ram 66 secured to an appropriate bumper plate 67 fixed to the underside of the upper plate 42. The hydraulic cylinder 64 is centrally mounted in a vertically extending position within a lower box-like housing 68, which is also conveniently sized for ready reception through the tank manhole 16. Thus, the cylinder 64 is fixed with respect to the lower housing 68 so that upward or downward movement of the ram 66 causes corresponding upward or downward movement of the upper plate 42 with respect to said lower housing.

The lower housing 68 has a pair of upper yokes 70 and a pair of lower yokes 72 projecting outwardly from the four corners of two opposed sides thereof. Similarly, the remaining two sides of said lower housing have aligned upper and lower pairs of holes 74 and 76 near the corners thereof for reception of upper and lower pairs of cross bars 78 and 80, respectively. Each end of the cross bars 78 and 80 is provided with a connecting yoke 82 in the same manner as the cross bars 54 of the upper plate 42. Thus, the housing 68 has four yokes extending outwardly from each side thereof.

The four sides of the lower housing 68 have their respective lower pairs of yokes 72 or 82 connected to a pair of parallel lower support arms 84. Said arms 84 have eyes 86 swingably received in the lower yokes 72 and 82 which are each held in position by bolts 88 having nuts 90 threaded thereon. Conveniently, safety cotter pins 92 are also provided if desired, and each pair of said arms 84 is cross and diagonally braced by braces 94. In a similar manner, upper support arms 96 are connected in parallel pairs to the upper yokes 70 and 82 on the four sides of the housing 68. These upper support arms 96 have eyes 98 at the ends thereof swingably received in their associated yokes, and secured in the same manner as the lower arms 84 by bolts 89, nuts 91, and pins 93. Again, each pair of upper arms 96 is conveniently cross and diagonally braced by braces 100.

Figure 4:
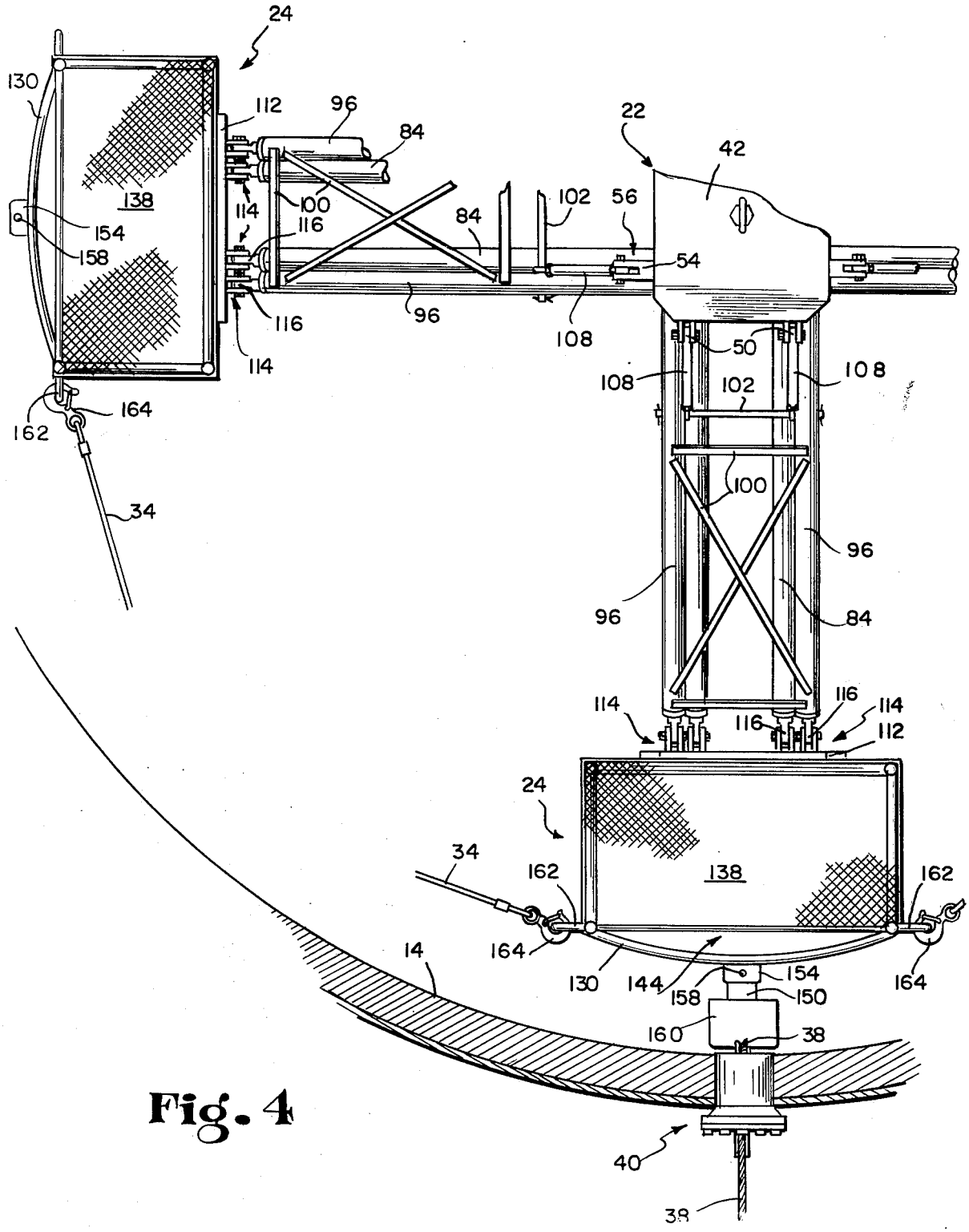
FIG. 4 is a fragmented top plan view of the scaffold taken on the line 4—4 of FIG. 1.
Figure 5:
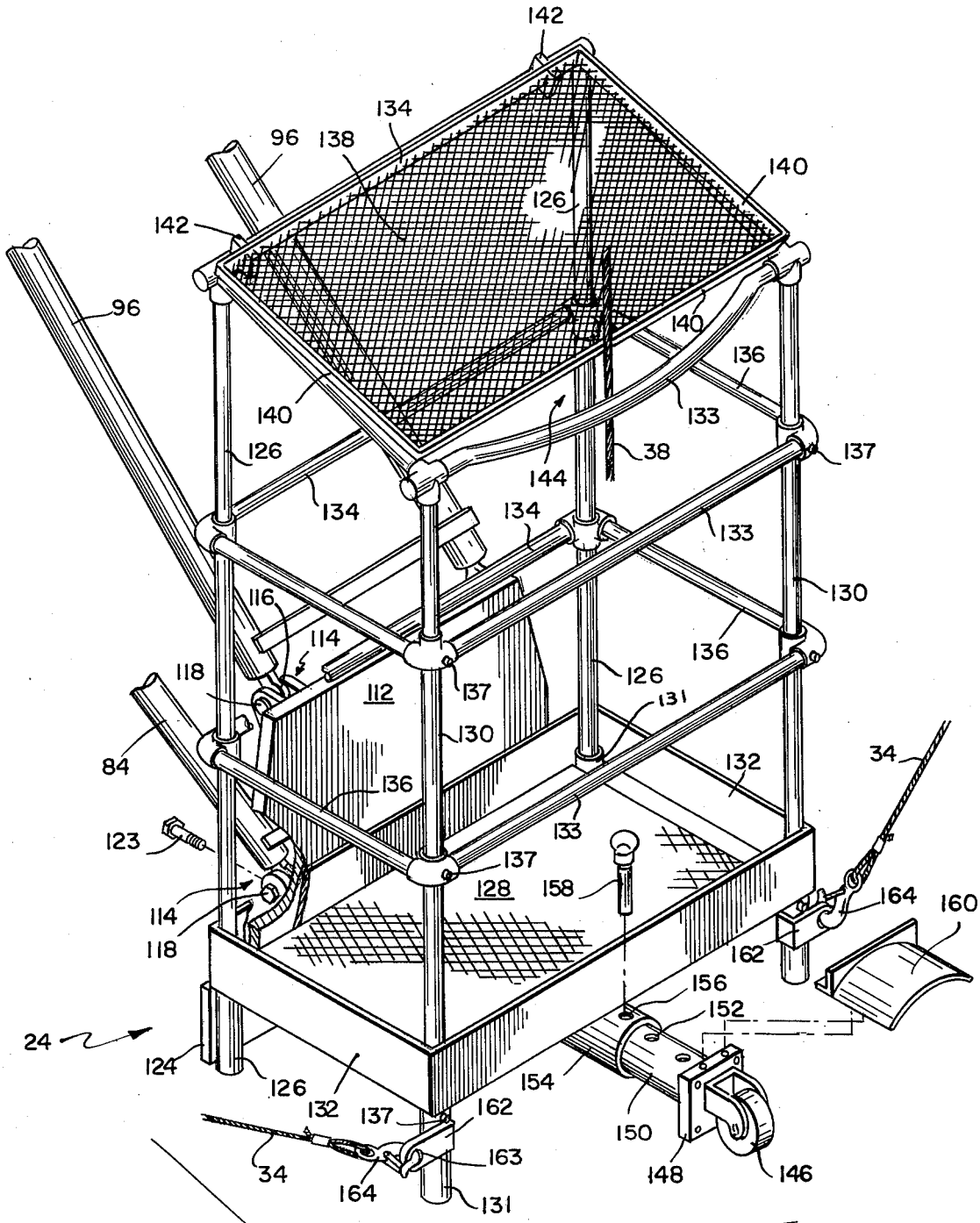
FIG. 5 is an enlarged fragmented perspective view, partially exploded, of one of the scaffold cages, with portions thereof broken away.

As shown in FIGS. 4 and 5, each of the four sets of upper and lower support arms 96 and 84 is swingably connected at their ends opposite the central frame 22 to one of the four scaffold cages 24. More specifically, as shown in FIG. 5, each scaffold cage 24 has a vertically oriented rectangular heel plate 112 with four rearwardly facing connector yokes 114 near the corners thereof. The yokes 114 swingably receive eyes 116 at the adjacent ends of the set of upper and lower support arms 96 and 84, with bolts 118, with associated nuts, and safety pins being provided to retain the eyes in said yokes. Importantly, the heel plate yokes 114 are positioned so that the upper and lower support arms 96 and 84 of each set of arms are always parallel to each other. This provides a parallel mechanical linkage between the scaffold central frame 22 and each scaffold cage 24 so that the cage heel plate 112 is always disposed vertically, regardless of the angular position of the support arms.

All of the yokes on the housing 68 and on the cage heel plates 112 are oriented to allow vertical movement of the support arms 96 and 84. Such movement is accomplished as shown in FIGS. 2 and 3 by actuation of the hydraulic cylinder 64. As shown, each set of support arms has its upper pair of arms 96 interconnected near the central frame housing 68 by a horizontally extending tie bar 102 retained in position by pins 104. Each tie bar 102 rotatably receives thereover the lower eyes 106 of a pair of upwardly extending actuator rods 108. The actuator rods 108 in turn have upper eyes 110 for reception in the adjacent yokes 50 or 56 of the upper plate 42, with said upper plate yokes being oriented to allow vertical movement of the actuator rods. These rods 108 are rotatably secured within the yokes 56 by the bolts 58, and in the yokes 50 by similar bolts 59, nuts 61, and pins 63. Thus, when the hydraulic cylinder 64 is actuated to raise the upper plate 42 of the central frame 22 as shown in FIG. 6, each set of upper and lower support arms 96 and 84 on each side of the frame is pivoted upwardly with respect to said frame as a parallel mechanical linkage. This simultaneously raises the four scaffold cages 24 coupled to the heel plates 112, and thereby adjusts the effective radial lengths of the support arms by altering the overall diameter of the entire scaffold. Of course, the maximum scaffold diameter is achieved when the support arms are in extended horizontal positions to allow workers in the cages 24 to reach portions of the tank walls of large diameter. When the hydraulic cylinder is actuated to lower the upper plate 42 of the central frame as shown in FIG. 7, the support arms are together pivoted downwardly as parallel linkages to decrease the effective radial lengths of the support arms, with a minimum-diameter retracted condition being achieved when the arms are nearly vertical. This retracted condition enables workers in the cages 24 to reach portions of the tank wall 14 of relatively small diameter. Thus, the effective lengths of the scaffold support arms are radially adjustable to reach portions of the inside wall 14 of a reactor tank having any diameter between the maximum and minimum scaffold diameters.

The four scaffold cages 24, or platforms, coupled to the sets of support arms 96 and 84 are all identical, with one of said scaffold cages being shown in detail in FIG. 5. As shown, the vertically oriented heel plate 112 of each cage is bolted by bolts 123 to a cage mounting plate 124. The mounting plate is in turn secured as by welding to a lower cage assembly comprising a floor 128 of metal grating or the like. Importantly, the floor 128 is oriented perpendicular to the heel plate 112 so that said floor is always horizontal regardless of the radially extended or retracted position of the support arms 96 and 84.

The floor 128 has an upwardly extending peripheral skirt 132 for helping to prevent tools, etc. from sliding out of the cage. The floor also has vertically oriented tubular sockets 131 connected at the corners thereof. The rear pair of sockets receive a pair of rear tubular uprights 126, and the front pair of sockets receive a pair of corresponding front tubular uprights 130. The front and rear uprights 130 and 126 together form an enclosing cage framework, and are interconnected at intervals by front, rear, and side tubular braces 133, 134, and 136, respectively. Conveniently, all of the tubular uprights, braces, and the floor assembly are assembled by means of pins 137 inside the reactor tank to form the completed cage. The assembled cage thus provides a relatively safe enclosure for a worker, and allows him to reach outwardly from the cage to clean the inside tank wall.

Each scaffold cage 24 has a protective screen 138 covering the top thereof. The screen 138 is retained within a rectangular frame 140 having hinge blocks 142 at the rear thereof. The hinge blocks 142 are received about the uppermost one of the rear braces 134 to allow rotation of the screen 138 about the horizontal axis of said uppermost brace. The screen frame 140 is not connected to the cage at any point, and extends forwardly along the cage sides to the front pair of tubular uprights 130, and then straight across the front of the cage. Conveniently, the uppermost one of the front tubular braces 133 is bowed outwardly, as at 144, to provide an opening between the bowed brace and the screen frame. This allows the worker safety cable 38 to be received downwardly into the cage enclosure between the screen frame 140 and the bowed upper brace 133 for fastening to a worker therein by a safety harness (not shown). Should the cage 24 fall for any reason, the safety cable 38 will cause the worker connected thereto to come out the top of the cage by pivoting the screen 138 upwardly and rearwardly to an open position when the worker's protective hat strikes said screen. In this manner, serious injury to the worker is avoided.

As shown in FIGS. 5–7, each of the scaffold cages 24 is provided with an outwardly projecting caster wheel 146 at the lower front thereof. The wheel 146 is horizontally mounted on a support plate 148 and is rotatable through an entire 360°. The support plate 148 is secured as by welding to a horizontally extending cylinder 150 having a plurality of holes 152 at spaced intervals along the top thereof. The cylinder 150 is slidably received into a mating cylindrical housing 154 fixed to the cage mounting plate 124 beneath the floor grate 128 as by welding. The housing 154 projects slightly outwardly of the cage front, and has one hole 156 in the top thereof. The hole 156 is alignable with any one of the holes 152 in the cylinder 150 to select the desired position of adjustment for the caster wheel 146, with a pin 158 being provided for insertion by the worker in the cage into the aligned holes to lock the caster wheel in position. In this manner, the radial extended or retracted location of the caster wheel is controllable to bear against the inside wall 14 of the tank to steady the scaffold and prevent swinging thereof. In practice, the cylinder holes 152 are drilled at approximately ½ inch to three-quarters inch increments, and are provided in sufficient number to allow adjustments of the wheel 146 over say about one foot. Thus, in operation, the overall diameter of the scaffold is roughly adjusted by actuation of the hydraulic cylinder 64 so that the cages 24 are positioned near the tank wall 14, and then the scaffold diameter is finely adjusted by extending the caster wheel on each cage to contact the tank wall. Conveniently, a shield 160 is mounted on each support block 148 to cover the caster wheel 146 and thereby prevent falling slag or the like from damaging or preventing rotation of the wheel.

Each scaffold cage 24, and thus the entire scaffold, is suspended by the cage cables 34. More specifically, each cage has a pair of brackets 162 fastened as by welding to the front pair of tubular sockets 131 below the cage floor 128. The brackets 162 each have a hole 163 therein for receiving hooks 164 on the ends of the cage cables 34. The eight cage cables 34 extend upwardly from the four cages 24 toward the top of the tank.

Figure 8:
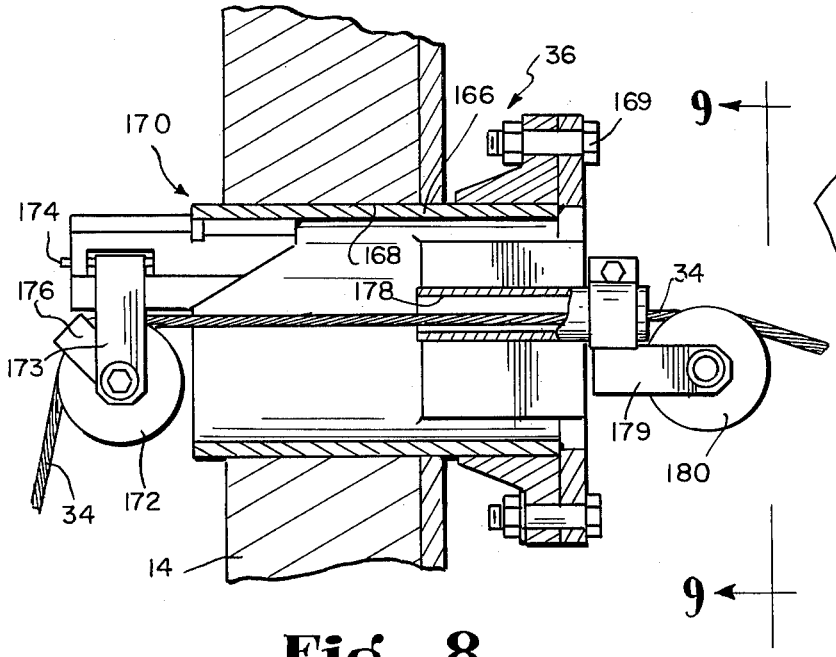
FIG. 8 is an enlarged vertical section of one of the double sheave assemblies taken on the line 8—8 of FIG. 1.
Figure 9:
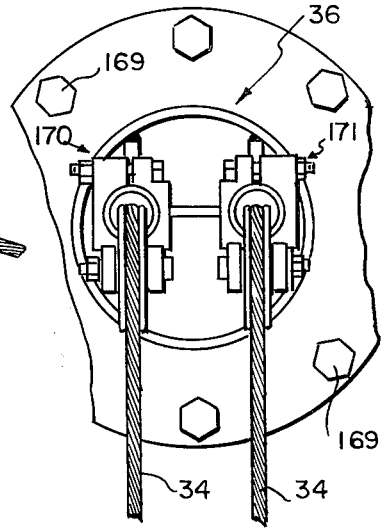
FIG. 9 is a front view of a double sheave assembly taken on the line 9—9 of FIG. 8.

The cage cables 34 are received over the double sheave assemblies 36, one of which is shown in detail in FIGS. 8 and 9. As shown, each double sheave assembly 36 comprises a cylindrical sleeve 166 received through an opening 168 in the tank wall and fastened in position by bolts 169. The sleeve 166 has a pair of two-sheave housings 170 and 171 fixedly mounted therein in axially aligned relationship as by welding. Each two-sheave housing has an inside sheave yoke 173 swingably connected to the housing by a pin 174. An inside sheave 172 is carried in the sheave yoke 173 and a cage cable 34 is received thereover. Conveniently, a keeper 176 is mounted on yoke 173 for retaining the cable on the associated sheave. The cable 34 extends outwardly through the sleeve 166 and an opening 178 in the housing, and is received over a rotatable outside sheave 180 carried in a sheave yoke 179. The outside sheave 180 guides the cable 34 outwardly and downwardly for connection to one of the individual winches 35, as shown in FIG. 12.

Figure 10:
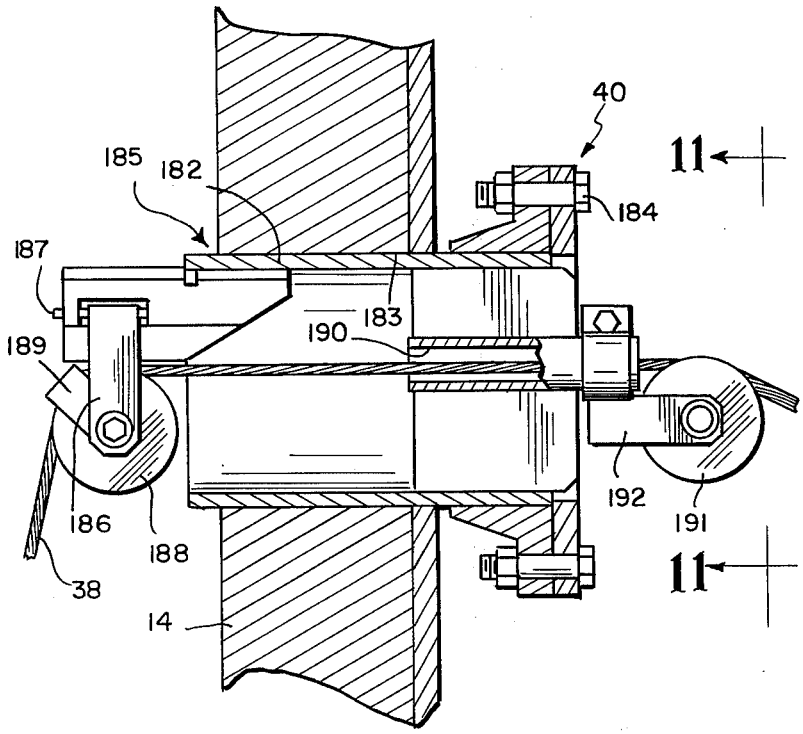
FIG. 10 is an enlarged vertical section of one of the single sheave assemblies taken on the line 10—10 of FIG. 1.
Figure 11:
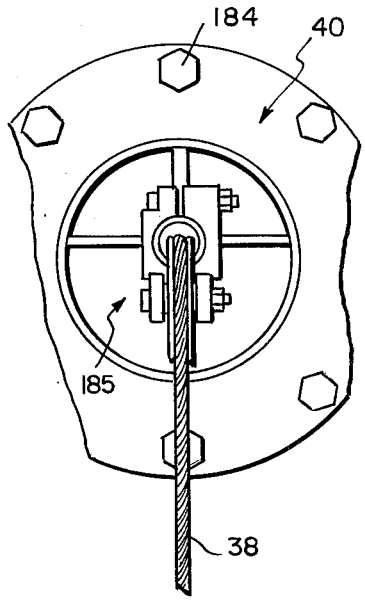
FIG. 11 is a front view of a single sheave assembly taken on the line 11—11 of FIG. 10.

As previously mentioned, the safety cables 38 extend upwardly from their associated cages 24, with each safety cable 38 being received over one of the single sheave assemblies 40. One of said single sheave assemblies 40 is shown in detail in FIGS. 10 and 11, and comprises a cylindrical sleeve 182 received through an opening 183 in the tank wall and fastened in position by bolts 184. The sleeve 182 has a one-sheave housing 185 axially mounted therein as by welding, with an inside sheave yoke 186 swingably connected thereto by a pin 187. An inside sheave 188 is carried in the sheave yoke 186 and receives one of the safety cables 38 thereover. Conveniently, a keeper 189 is provided on the yoke 186 to retain the cable on the sheave. The cable extends outwardly through the sleeve 182 and an opening 190 in the housing 185 for reception over an outside sheave 191 carried in an outside sheave yoke 192. The outside sheave 191 guides the cable 38 outwardly and downwardly for connection to one of the safety cable winches 37, as shown in FIG. 12.

Figure 12:
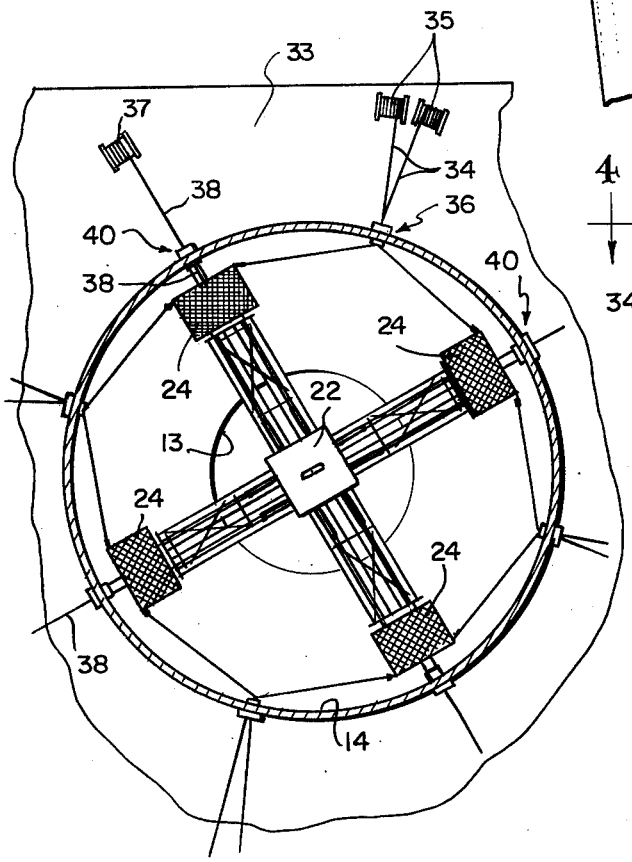
FIG. 12 is a vertical section of the reactor tower taken on the line 12—12 of FIG. 1.

The relative radial locations of the winches 35 and 37, and the double and single sheave assemblies 36 and 40 are shown in FIG. 12. As shown, the double sheave assemblies 36 are disposed in the tank wall generally radially between the cages 24, and the cage winches 35 are positioned in pairs radially outwardly from the double sheave assemblies 36. Importantly, each of the double sheave assemblies 36 has received thereover a pair of the cables 34 connected to adjacent sides of adjacent cages 24. Thus, each pair of the winches 35 has a pair of cables wound thereabout connected to adjacent sides of two different cages 24. In this manner, when all of the winches 35 are simultaneously operated to wind the cage cables 34 about their drums, the four scaffold cages are together lifted within the tank. Similarly, opposite simultaneous rotation of the winches serves to lower the cages within the tank.

The cage winches 35 are also controllable to rotate the cages 24 within the tank. For example, when each adjacent pair of winches 35 is identically operated with one winding cable and the other unwinding cable, the cages 24 are caused to rotate. The direction of rotation depends upon which winch of each pair is winding cable and which one is unwinding. In operation of the scaffold, the cages are first rotated in one direction through an angle of approximately 45°, until the cages are directly under the double sheave assemblies 36, and then in the other direction approximately 45° from their initial positions to allow the workers in the cages easy access to the entire 360° of the inside wall 14 of the tank. Of course, cage rotation slightly varies the scaffold elevation within the tank, but elevational adjustments are made after rotation by operating the winches 35 as hereinbefore described to raise or lower the cages. During such raising and lowering, or rotating of the cages, the hydraulic cylinder 64 in the scaffold central framework 22 is operable to appropriately adjust the extended or retracted position of the cages 24 within the tank.

The safety cables 38 are wound or unwound about the drums of their winches 37 in accordance with the elevation of the cages within the tank. That is, the safety cables are adjusted to take up excess cable slack when the cages are raised, and to maintain a slight degree of slack when the cages are lowered. The main cable 26 has its length similarly controlled by operation of its associated winch 31.

While no specific control for the various winches 31, 35 and 37 is shown in the drawings, it is contemplated that all of the winches are electrically operated and controlled by switches. The winches are desirably wired so that one switch serves to operate all of the winches to raise or lower the scaffold, and a second serves to cause clockwise or counterclockwise scaffold rotation. Further, individual switches are contemplated for each winch to allow individual cable length adjustments to account for stretching, etc. All of the switches are mounted in a central control cabinet (not shown) which can be positioned in any convenient location either inside or outside of the tank. Or, if desired, dual control panels can be provided to allow the scaffold position to be adjusted from either the inside or the outside of the tank.

Figure 13:
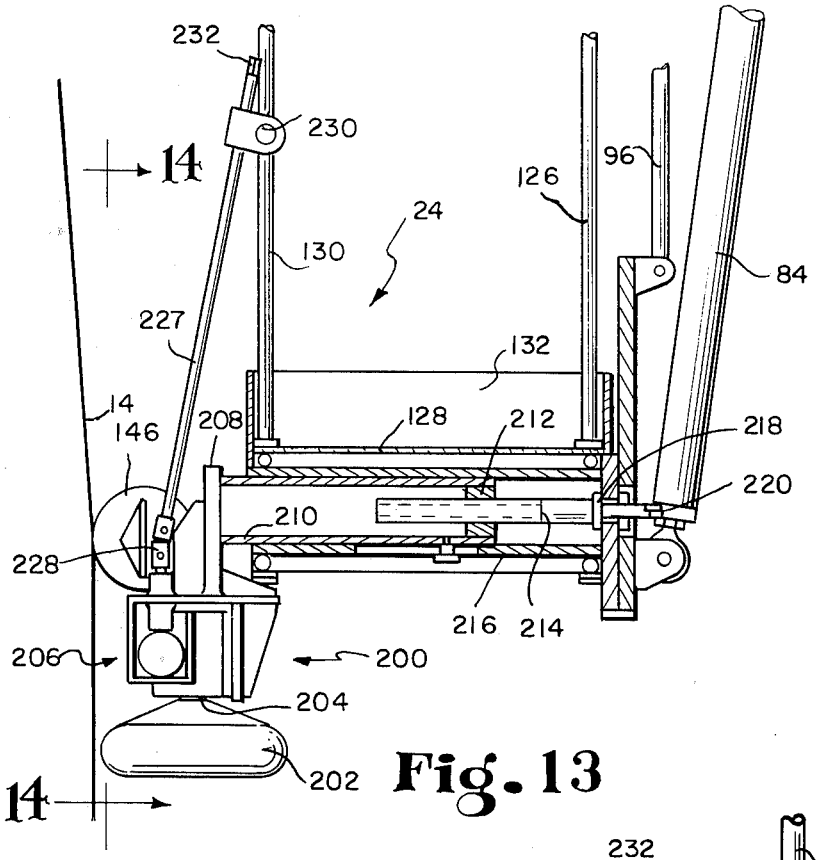
FIG. 13 is an enlarged fragmented side elevation of a modified scaffold cage having a rotating drive assembly mounted thereon, with portions thereof broken away.
Figure 14:
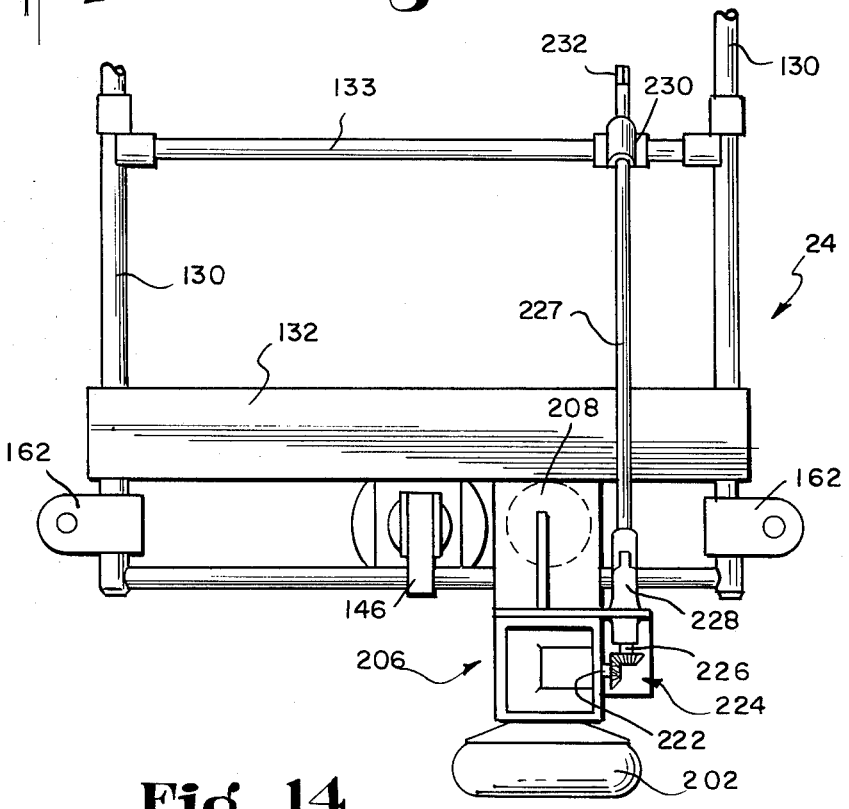
FIG. 14 is a front elevation of the modified scaffold cage taken on the line 14—14 of FIG. 13.

Alternate apparatus for rotating the scaffold cages 24 within the tank is shown in FIGS. 13 and 14. As shown, at least one of the scaffold cages 24 has a rotating drive assembly 200 mounted on the bottom thereof in addition to and alongside the caster wheel 146. The drive assembly 200 comprises a rubber-covered wheel 202 carried on a rotatable axle 204. The wheel 202 is horizontally mounted with its axle received upwardly into a gear housing 206. The gear housing 206 is mounted as by welding to a mounting plate 208 which is in turn welded to a horizontally rearwardly extending cylinder 210. The cylinder 210 has a nut 212 fixed as by welding within its rear end, and said nut 212 is threadably received over a threaded shaft 214. The shaft 214 is fixedly carried within a main housing 216 welded to the underside of the cage 24, and extends rearwardly of the cage through a thrust washer 218 in the cage mounting plate 214 and terminates in a hex head 220. The hex head 220 is selectively rotatable by the worker in the cage to advance the rubbered wheel 202 outwardly into engagement with the inside wall 14 of the tank, or rearwardly away from the wall. Alternately, if desired, the hex head can be automatically turned with the provision of suitable electric-powered apparatus.

As shown in FIG. 14, the gear housing 206 has a shaft 222 extending outwardly therefrom and coupled to one gear of a miter gear set 224. The other gear of the gear set 224 is connected to a vertical shaft 226 terminating at a universal joint 228. A rod 227 extends upwardly from the universal joint 228, is positioned on the cage by a bracket 230, and has a hex head 232 at its upper end. The hex head is rotatable by the worker in the cage to controllably rotate the rubbered wheel 202 in the desired direction to rotate the scaffold. Alternately, if desired, the hex head can be automatically turned with suitable apparatus. Thus, when the rubbered wheel 202 is brought into contact with the inside tank wall 14, said wheel is rotatable to rotate the scaffold cages 24 in the desired direction.

The scaffold of this invention thus provides an easily assembled, easily operated apparatus for gaining access to the inside wall of an upright cylindrical tank. All of the scaffold components are easily passed through a small opening in the tank and then quickly assembled. It is contemplated that the scaffold is raised to the desired maximum elevation, and the tank inside wall cleaned from the top toward the bottom. As the work progresses, the scaffold is elevationally, diametrically, and rotatably adjusted so that the scaffold cages are positionable to allow easy access to all 360° of the inside tank wall.

While the scaffold of this invention has been described for use in cleaning a variable diameter refinery reactor tank, it is contemplated that the scaffold be used with a wide variety of upright cylindrical tanks and hollow vessels. For example, the scaffold is usable within water towers, or any other similar vessel wherein periodic access to the inside vessel wall is necessary.

We claim:

1. A hanging scaffold comprising a self-contained central frame having upper and lower frame members; a plurality of support arms pivotally connected to one of said frame members and extending radially outwardly therefrom; a plurality of platforms connected to said support arms opposite said frame; first adjustment means for selectively raising and lowering said upper and lower frame members with respect to each other, said first adjustment means having means interconnecting the other of said frame members with said support arms so as to cause inward and outward movement of said arms in response to relative movement of said frame members to adjust the radial distance of said platforms from said frame; support means for elevationally suspending said frame, support arms and platforms from above; and second adjustment means connected to said support means for selectively adjusting the elevation of said frame, support arms, and platforms.

2. A scaffold as set forth in claim 1 wherein said plurality of support arms comprises a plurality of support arm sets extending radially outwardly from said central frame, each of said plurality of platforms being connected to one of said support arm sets.

3. A scaffold as set forth in claim 1 wherein said first adjustment means comprises a reversible hydraulic cylinder connected between said upper and lower frame members.

4. A scaffold as set forth in claim 1 wherein said plurality of support arms comprises a plurality of support arm sets each being pivotally connected at one end to said one frame member and at the other end to one of said platforms, said support arm sets each comprising a parallel mechanical linkage.

5. A scaffold as set forth in claim 1 wherein each of said platforms comprises a cage having a floor with a relatively open protective framework extending upwardly therefrom for substantially surrounding a worker therein.

6. A scaffold as set forth in claim 1 wherein each of said platforms comprises a cage having a floor with a relatively open protective framework extending upwardly therefrom for substantially surrounding a worker therein, said cage framework having a protective cover panel substantially closing the top thereof and hinged to said framework to swing upwardly to an open position, said cover panel and framework being shaped to allow passage therebetween of safety cable means for connection to a worker in said cage.

7. A scaffold as set forth in claim 1 wherein said support means comprises a cable connected to said upper frame member and extending upwardly therefrom, and said second adjustment means comprises a winch for selectively winding and unwinding said cable.

8. A scaffold as set forth in claim 1 wherein said support means comprises a plurality of cables connected to said platforms and extending upwardly therefrom, and said second adjustment means comprises a plurality of winches for selectively winding and unwinding said cables.

9. A scaffold as set forth in claim 1 with the addition of sheave means mounted above said scaffold, said support means comprising a plurality of cables connected to said platforms and received over said sheave means, and said second adjustment means comprising a plurality of winches for selectively winding and unwinding said cables for adjusting the elevation of said platforms.

10. A scaffold as set forth in claim 1 wherein said support means comprises a plurality of cables with each of said platforms having a pair of the cables connected to opposed sides thereof, each of said cables extending upwardly from its associated platform and received over sheave means mounted above said scaffold, said second adjustment means comprising a plurality of winches each having one of the cables wound thereabout and selectively operable to wind and unwind said cable.

11. A scaffold as set forth in claim 10 wherein said sheave means are disposed in pairs generally radially between said platforms and having their associated cables connected to adjacent sides of adjacent platforms, said winches being selectively operable to simultaneously wind the cable connected to one side of each platform and to unwind the cable connected to the other side of each platform whereby said platforms are selectively rotatable about a vertical axis extending through said central frame.

12. A scaffold as set forth in claim 1 wherein each of said platforms has adjustable caster means extending radially outwardly therefrom.

13. A scaffold as set forth in claim 1 wherein at least one of said platforms has a rotatable drive assembly mounted thereon having an adjustable wheel extending radially outwardly therefrom for bearingly engaging the inside wall of an upright cylinder when said scaffold is received therein, said drive assembly having drive means for allowing controllable rotation of said wheel to rotate said scaffold with said cylinder.

14. A hanging scaffold for use in gaining access to the inside wall of an upright cylindrical tank comprising a self-contained central frame having upper and lower frame members; a plurality of support arm sets each having one end pivotally connected for vertical movement to one of said frame members and extending radially outwardly therefrom; a plurality of platforms each connected to one of said support arm sets opposite said central frame; first adjustment means for selectively raising and lowering said frame members with respect to each other, said first adjustment means having means connected between the other of said frame members and said support arm sets at points displaced from the connections of said arm sets to said one frame member for pivoting said arm sets with respect to said one frame member upon relative raising and lowering of said frame members to adjust the radial distances of said platforms from said frame; suspension means for elevationally suspending said frame, support arm sets, and platforms from above; second adjustment means connected to said suspension means for adjusting the length thereof; and rotating means for rotating said platforms about a vertical axis extending through said frame.

15. A scaffold as set forth in claim 14 wherein each of said support arm sets comprises a parallel mechanical linkage pivotally connected for vertical movement at one end to said one frame member and at the other end to one of said platforms whereby said platforms retain the same angular relationship with respect to said frame regardless of the radial distance of said platform from the frame.

16. A scaffold as set forth in claim 14 wherein each of said platforms comprises a cage having a floor with a relatively open protective framework extending upwardly therefrom for substantially surrounding a worker therein, said framework having a protective cover panel substantially closing the top thereof and hinged thereto to swing upwardly to an open position, said cover panel and framework being shaped to allow passage therebetween of safety cable means for attachment to a worker therein.

17. A scaffold as set forth in claim 14 wherein said suspension means comprises a cable connected to said central frame, and said second adjustment means comprises a winch for selectively winding and unwinding said cable to adjust the elevation of the scaffold within the tank.

18. A scaffold as set forth in claim 14 wherein said suspension means comprises a plurality of cables connected to said platforms, and said second adjustment means comprises a plurality of winches for selectively winding and unwinding said cables to adjust the elevation of the scaffold within the tank.

19. A scaffold as set forth in claim 14 wherein said rotating means comprises a plurality of cables with one of said cables connected to each of opposed sides of each platform; a plurality of sheave means disposed generally radially between said platforms, each of said sheave means having a pair of said cables received thereover with said pair of cables being connected to adjacent sides of adjacent platforms; and a plurality of winches each having one of said cables wound thereabout, said winches being selectively operable to simultaneously wind the cable connected to one side of each platform and to unwind the cable connected to the other side of each platform whereby the platforms are rotated within the tank.

20. A scaffold as set forth in claim 14 wherein said rotating means comprises a plurality of cables with one of said cables connected to each of opposed sides of each platform; a plurality of winches each having one of said cables wound thereabout, said winches being disposed in pairs generally radially between said platforms with each pair of winches having their associated cables connected to adjacent sides of adjacent platforms, said winches being selectively operable to simultaneously wind the cable connected to one side of each platform and to unwind the cable connected to the other side of each platform whereby the platforms are rotated within the tank.

21. A scaffold as set forth in claim 14 wherein said suspension means and said rotating means comprises a plurality of cables with one of said cables connected to each of opposed sides of each platform; a plurality of sheave means disposed generally radially between said platforms, each of said sheave means having a pair of said cables received thereover with said pair of cables being connected to adjacent sides of adjacent platforms; and a plurality of winches each having one of said cables wound thereabout, said winches being selectively operable to simultaneously wind the cable connected to one side of each platform and to unwind the cable connected to the other side of each platform whereby the platforms are rotated within the tank.

22. A scaffold as set forth in claim 14 with the addition of adjustable caster means mounted on each of said platforms and extending radially outwardly therefrom to engage the inside wall of the tank.

23. A scaffold as set forth in claim 14 wherein said rotating means comprises a rotatable drive assembly mounted on at least one of said platforms, said drive assembly having an adjustable wheel extending radially outwardly therefrom for bearingly engaging the inside wall of the tank and drive means for allowing controllable rotation of said wheel to rotate said platforms within the tank.

24. A scaffold for use in gaining access to the inside wall of an upright cylindrical tank comprising a central frame having upper and lower members; means for raising and lowering said frame members with respect to each other; a plurality of platforms; a plurality of support arm sets each comprising a parallel mechanical linkage and extending radially outwardly from said central frame, each of said arm sets being pivotally connected for vertical movement between one of said frame members and one of said platforms; actuating means pivotally connected for vertical movement between the other of said frame members and each of said arm sets at points displaced from the connections of said arm sets with said one frame member whereby relative raising and lowering of said frame members adjusts the radial distances of said platforms from said frame; a plurality of cables with each of said cables being connected to one of opposed sides of each platform; a plurality of sheave means disposed above and generally radially between said platforms and each having a pair of said cables received thereover with said pair of cables being connected to adjacent sides of adjacent platforms; and a plurality of winches each having one of said cables wound thereabout, said winches being simultaneously operable to selectively wind or unwind said plurality of cables to correspondingly adjust the elevation of said platforms within the tank, said winches being also simultaneously operable to wind the cable connected to one side of each platform and to unwind the cable connected to the other side of each platform to selectively rotate the platforms within the tank about a vertical axis extending through the central frame.

25. A scaffold for use in gaining access to the inside wall of an upright cylindrical tank comprising a central frame having upper and lower members; means for raising and lowering said frame members with respect to each other; a plurality of platforms; a plurality of support arm sets each comprising a parallel mechanical linkage and extending radially outwardly from said central frame, each of said arm sets being pivotally connected for vertical movement between one of said frame members and one of said platforms; actuating means pivotally connected for vertical movement between the other of said frame members and each of said arm sets at points displaced from the connections of said arm sets with said one frame member whereby relative raising and lowering of said frame members adjusts the radial distances of said platforms from said frame; a plurality of cables with each of said cables being connected to one of opposed sides of each platform; a plurality of winches each having one of said cables wound thereabout, said winches being disposed in pairs above and generally radially between said platforms with each pair of winches having their associated cables connected to adjacent sides of adjacent platforms, said winches being simultaneously operable to selectively wind or unwind said plurality of cables to correspondingly adjust the elevation of said platforms within the tank, said winches being also simultaneously operable to wind the cable connected to one side of each platform and to unwind the cable connected to the other side of each platform to selectively rotate the platforms within the tank about a vertical axis extending through the central frame.

26. A scaffold for use in gaining access to the inside wall of an upright cylindrical tank comprising a central frame having upper and lower members; means for raising and lowering said frame members with respect to each other; a plurality of platforms; a plurality of support arm sets each comprising a parallel mechanical linkage and extending radially outwardly from said central frame, each of said arm sets being pivotally connected for vertical movement between one of said frame members and one of said platforms; actuating means pivotally connected for vertical movement between the other of said frame members and each of said arm sets at points displaced from the connections of said arm sets with said one frame member whereby relative raising and lowering of said frame members adjusts the radial distances of said platforms from said frame; suspension means for suspending said frame, arm sets, and platforms from above; adjustment means connected to said suspension means for adjusting the length thereof to adjust the elevation of said platforms within the tank; and a rotatable drive assembly mounted on at least one of said platforms, said drive assembly having an adjustable wheel extending radially outwardly therefrom for bearingly engaging the inside wall of the tank and drive means for allowing controllable rotation of said wheel to rotate said platforms within the tank.

27. A scaffold comprising a central frame; first support means connected to said frame and extending radially outwardly therefrom; a plurality of platforms connected to said first support means opposite said frames, each of said platforms having a floor with a relatively open protective framework extending upwardly therefrom for substantially surrounding a worker therein, said cage framework having a protective cover panel substantially closing and hinged to the top of said framework to swing upwardly to an open position, said cover panel and framework being shaped to allow passage therebetween of safety cable means for connection to a worker in said cage; first adjustment means for adjusting the radial distance of said platforms from said frame; second support means for elevationally supporting said frame, first support means, and platforms; and second adjustment means for selectively adjusting the elevation of said frame, first support means, and platforms.

28. A scaffold comprising a central frame; support means connected to said frame and extending radially outwardly therefrom; a plurality of platforms connected to said support means opposite said frame; adjustment means for adjusting the radial distance of said platforms from said frame; a plurality of cables connected to said platforms and extending upwardly therefrom for elevationally supporting said frame, support means and platforms from above; and a plurality of winches connected to said plurality of cables for selectively winding and unwinding said cables for selectively adjusting the elevation of said frame, support means, and platforms.

29. A scaffold comprising a central frame; support means connected to said frame and extending radially outwardly therefrom; a plurality of platforms connected to said support means opposite said frame; adjustment means for adjusting the radial distance of said platforms from said frame; sheave means mounted above the scaffold; a plurality of cables connected to said platforms and extending upwardly therefrom over said sheave means for elevationally supporting said frame, support means and platforms from above; and a plurality of winches connected to said plurality of cables for selectively winding and unwinding said cables for selectively adjusting the elevation of said frame, support means, and platforms.

30. A scaffold comprising a central frame; support means connected to said frame and extending radially outwardly therefrom; a plurality of platforms connected to said support means opposite said frame; adjustment means for adjusting the radial distance of said platforms from said frame; a plurality of cables connected to said platforms and extending upwardly therefrom for elevationally supporting said frame, support means and platforms from above, each of said platforms having a pair of said cables connected thereto at opposed sides thereof, and each of said cables being received over sheave means mounted above the scaffold; and a plurality of winches each having one of said cables wound thereabout and selectively operable to wind and unwind said cables for selectively adjusting the elevation of said frame, support means, and platforms.

31. A scaffold as set forth in claim 30 wherein said sheave means are disposed in pairs generally radially between said platforms and have their associated cables connected to adjacent sides of adjacent platforms, said winches being selectively operable to simultaneously wind the cable connected to one side of each platform and to unwind the cable connected to the other side of each platform whereby said platforms are selectively rotatable about a vertical axis extending through said central frame.

32. A scaffold for use in gaining access to the inside wall of an upright cylindrical tank comprising a central frame; a plurality of support arm sets each having one end pivotally connected to said frame and extending radially outwardly therefrom; a plurality of platforms each connected to one of said support arm sets opposite said central frame, each of said platforms having a floor with a relatively open protective framework extending upwardly therefrom for substantially surrounding a worker therein, said framework having a protective cover panel substantially closing and hinged to the top of said framework to swing upwardly to an open position, said cover panel and framework being shaped to allow passage therebetween of safety cable means for attachment to a worker therein; first adjustment means connected between said frame and support arm sets for pivoting said arm sets with respect to said frame to adjust the radial distances of said platforms from said frame; suspension means for suspending said frame, support arm sets, and platforms from above; second adjustment means connected to said suspension means for adjusting the length thereof; and rotating means for rotating said platforms about a vertical axis extending through said frame.

33. A scaffold for use in gaining access to the inside wall of an upright cylindrical tank comprising a central frame; a plurality of support arm sets each having one end pivotally connected to said frame and extending radially outwardly therefrom; a plurality of platforms each connected to one of said support arm sets opposite said central frame; adjustment means connected between said frame and support arm sets for pivoting said arm sets with respect to said frame to adjust the radial distances of said platforms from said frame; a plurality of cables connected to said platforms for suspending said frame, support arm sets, and platforms from above; a plurality of winches for selectively winding and unwinding said cables to adjust the elevation of the scaffold within the tank; and rotating means for rotating said platforms about a vertical axis extending through said frame.

34. A scaffold for use in gaining access to the inside wall of an upright cylindrical tank comprising a central frame; a plurality of support arm sets each having one end pivotally connected to said frame and extending radially outwardly therefrom; a plurality of platforms each connected to one of said support arm sets opposite said central frame; first adjustment means connected between said frame and support arm sets for pivoting said arm sets with respect to said frame to adjust the radial distances of said platforms from said frame; suspension means for suspending said frame, support arm sets, and platforms from above; second adjustment means connected to said suspension means for adjusting the length thereof; and rotating means for rotating said platforms about a vertical axis extending through said frame, said rotating means having a plurality of cables with one of said cables connected to each of opposed sides of each platform, a plurality of sheave means disposed generally radially between said platforms, each of said sheave means having a pair of said cables received thereover with said pair of cables being connected to adjacent sides of adjacent platforms, and a plurality of winches each having one of said cables wound thereabout, said winches being selectively operable to simultaneously wind the cable connected to one side of each platform and to unwind the cable connected to the other side of each platform whereby the platforms are rotated within the tank.

35. A scaffold for use in gaining access to the inside wall of an upright cylindrical tank comprising a central frame; a plurality of support arm sets each having one end pivotally connected to said frame and extending radially outwardly therefrom; a plurality of platforms each connected to one of said support arm sets opposite said central frame; first adjustment means connected between said frame and support arm sets for pivoting said arm sets with respect to said frame to adjust the radial distances of said platforms from said frame; suspension means for suspending said frame, support arm sets, and platforms from above; second adjustment means connected to said suspension means for adjusting the length thereof; and rotating means for rotating said platforms about a vertical axis extending through said frame, said rotating means having a plurality of cables with one of said cables connected to each of opposed sides of each platform; a plurality of winches each having one of said cables wound thereabout, said winches being disposed in pairs generally radially between said platforms with each pair of winches having their associated cables connected to adjacent sides of adjacent platforms, said winches being selectively operable to simultaneously wind the cable connected to one side of each platform and to unwind the cable connected to the other side of each platform whereby the platforms are rotated within the tank.

36. A scaffold for use in gaining access to the inside wall of an upright cylindrical tank comprising a central frame; a plurality of support arm sets each having one end pivotally connected to said frame and extending radially outwardly therefrom; a plurality of platforms each connected to one of said support arm sets opposite said central frame; first adjustment means connected between said frame and support arm sets for pivoting said arm sets with respect to said frame to adjust the radial distances of said platforms from said frame; suspension and rotating means for suspending said frame, support arm sets, and platforms from above and for rotating said platforms about a vertical axis extending through said frame, said suspension and rotating means having a plurality of cables with one of said cables connected to each of opposed sides of each platform; a plurality of sheave means disposed generally radially between said platforms, each of said sheave means having a pair of said cables received thereover with said pair of cables being connected to adjacent sides of adjacent platforms; and a plurality of winches each having one of said cables wound thereabout, said winches being selectively operable to simultaneously wind the cable connected to one side of each platform and to unwind the cable connected to the other side of each platform whereby the platforms are rotated within the tank.

* * * * *

UNITED STATES PATENT OFFICE

CERTIFICATE OF CORRECTION

Patent No. 4,058,184 Dated November 15, 1977

Inventor(s) Alistair J. Stuart and James B. Burch

It is certified that error appears in the above-identified patent and that said Letters Patent are hereby corrected as shown below:

Column 3, line 33, change "plant" to --plank--.

Column 11, line 5 (Claim 13), change "with" to --within--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*